United States Patent [19]

Kurzman

[11] Patent Number: 5,057,977

[45] Date of Patent: Oct. 15, 1991

[54] PULL-OUT LIGHTED DISPLAY

[75] Inventor: Alan M. Kurzman, Dallas, Tex.

[73] Assignee: Triangle Pacific Corp., Dallas, Tex.

[21] Appl. No.: 510,099

[22] Filed: Apr. 17, 1990

[51] Int. Cl.[5] ..... A47F 3/06; A47F 11/10

[52] U.S. Cl. ..... 362/125; 362/367; 362/802; 312/131; 312/122; 312/223

[58] Field of Search ..... 362/125, 802, 367; 312/122, 131, 132, 223, 322, 330

[56] References Cited

U.S. PATENT DOCUMENTS

| | | | |
|---|---|---|---|
| 559,068 | 4/1896 | Vess et al. | 312/131 |
| 1,506,086 | 8/1924 | Ruby | 312/122 |
| 2,602,252 | 7/1952 | Shinn | 362/125 X |
| 2,686,252 | 8/1954 | Geraci | 362/802 X |
| 2,840,228 | 6/1958 | Takacs | 362/125 X |
| 4,723,819 | 2/1988 | Ramberg | 312/223 X |
| 4,926,294 | 5/1990 | Beaulieu et al. | 362/125 |

*Primary Examiner*—Ira S. Lazarus
*Assistant Examiner*—Y. Quach

[57] ABSTRACT

A pull-out lighted display includes a plurality of vertically oriented modules arranged side-by-side in a housing having an open front. Each module is removable from and retractable into the housing independently of the other modules and includes first and second opposed panels, connected to define a substantially enclosed casing. Each of the panels is adapted for displaying merchandise and a graphic depicting the merchandise. A light source is disposed within the casing for backlighting the graphics disposed on the opposed panels. Each module is mounted for rotation about a vertical axis when the module is removed from the housing to expose either or both of the panels for viewing. A switch member is positioned in the housing behind each module for automatically enabling the light source associated with the corresponding module to illuminate the display when the corresponding module is pulled out of the housing, and for automatically disabling the light source when the module is retracted back into the housing.

18 Claims, 3 Drawing Sheets

PULL-OUT LIGHTED DISPLAY

FIELD OF THE INVENTION

This invention relates to illuminated display devices, and in particular to devices for displaying merchandise samples and graphics depicting selected applications of such merchandise.

BACKGROUND OF THE INVENTION

Devices for displaying merchandise samples and/or photographs of merchandise are commonly required by a variety of trades and businesses. Such displays are typically configured to attract the attention of customers and potential customers by presenting the merchandise, in an attractive manner. Furthermore, because space is at a premium at showrooms and the like, it is often advantageous to display photographs of the merchandise, rather than the merchandise itself, with such photographs being illuminated to enhance the overall appearance thereof.

DESCRIPTION OF THE PRIOR ART

According to prior practice, display devices may include relatively flat panels for displaying various items. Illumination means may be disposed behind the panel for illuminating the display, particularly when photographs are used. A plurality of display devices may be arranged in a cabinet or on a display rack.

For example, U.S. Pat. No. 274,032, issued to Reynolds on March 13, 1883, teaches a display device comprised of a plurality of relatively flat panels having merchandise thereon, each panel being stacked above one another within a storage casing. Each panel is slidably mounted within the casing, such that when a particular panel is pulled horizontally outward from the casing, the leading portion of the panel will topple downward to reveal the relatively flat face of the panel and its associated merchandise.

U.S. Pat. No. 1,767,980, issued to Hintze on June 24, 1930, teaches a display rack on which a plurality of casings are pivotally attached. Each of the casings contains a plurality of cards or other photographs for viewing. U.S. Pat. No. 4,209,212, issued to McGoldrick on June 24, 1980, teaches a jewelry display housing in which jewelry is mounted on a fabric-like backing. Illumination means is mounted within the housing and automatically activated when the doors of the housing are open.

OBJECTS OF THE INVENTION

It is therefore the principal object of the present invention to provide a new and improved space-saving display device.

Another object of the invention is to provide an improved merchandise display which is disposed within a storage cabinet when not in use and which is illuminated upon withdrawal from the storage cabinet.

Yet another object of the invention is to provide an improved merchandise display having a plurality of individual modules, arranged in vertical orientation.

Still another object of the invention is to provide an improved merchandise display which includes phototransparencies of selected merchandise.

A further object of the invention is to provide an improved merchandise display in which both samples of the merchandise and the graphics depicting the use of such merchandise are displayed in such a manner that the merchandise is visually simulated in the particular layout depicted in the corresponding graphics.

SUMMARY OF THE INVENTION

These and other objects are achieved in accordance with the present invention wherein a display device having at least one display module, which is removable from and retractable into a display housing, is provided for displaying selected merchandise. The display module includes a graphic depicting the merchandise and means for illuminating the graphic when the module is withdrawn from the housing.

In one aspect of the invention, the device includes a plurality of display modules in vertical orientation, side-by-side within the housing. Individual modules can be withdrawn from the housing for convenient viewing. Each module preferably includes front and back panels for displaying the merchandise of interest and is pivotally mounted, such that the corresponding module is rotatable about a vertical axis to facilitate the viewing of both the front and back display panels.

In accordance with a particular unique feature of the invention, both the samples of the merchandise as well as a graphic depicting the use of such merchandise are disposed on the display panel in such a manner that the merchandise itself is visually simulated in the particular layout depicted in the corresponding graphic. For example, the merchandise being displayed may include sample kitchen fixtures, such as upper and lower cabinets, with a drawer and a piece simulating a countertop disposed therebetween, all of such fixtures being mounted on a display panel. A graphic is then also disposed on such display panel, for example, intermediate the upper cabinet and the countertop piece, and depicts the sample fixtures in situ. Various merchandise samples and their corresponding graphic can preferably be disposed on both the front and back display panels of the display module. An illumination device, such as a fluorescent light source, is disposed between the front and back panels to illuminate the graphics.

BRIEF DESCRIPTION OF THE DRAWINGS

Other objects and advantages of the invention will be apparent from the following Detailed Description when read in conjunction with the accompanying Drawings, wherein.

DETAILED DESCRIPTION OF THE PREFERRED EMBODIMENT

In the description which follows, like parts are marked throughout the specification and drawings, respectively. The drawings are not necessarily to scale, and in some instances proportions have been exaggerated in order to more clearly emphasize certain features of the invention.

Figure 1:
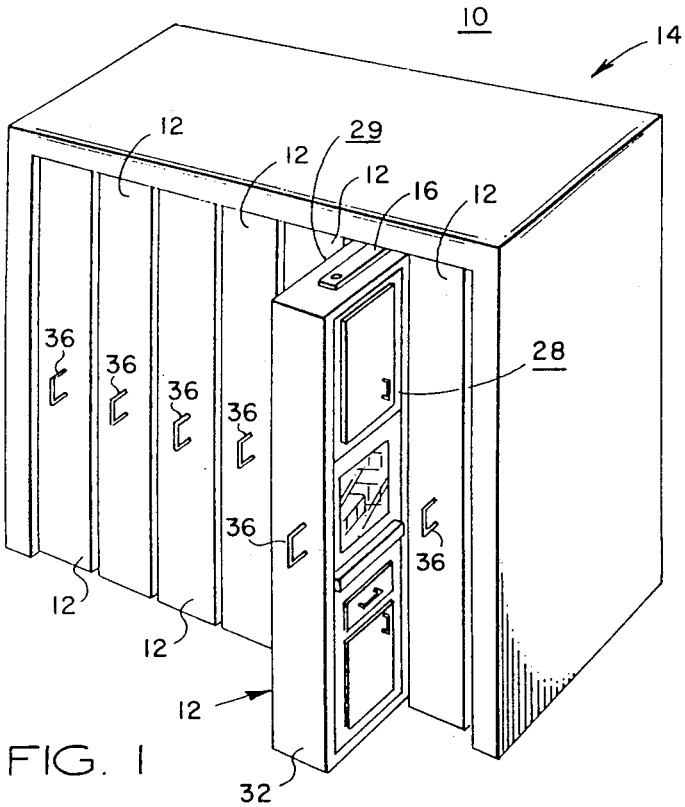
FIG. 1 is a perspective view, of the display device of the invention, illustrating one of the display modules thereof removed from the display housing.
Figure 2:
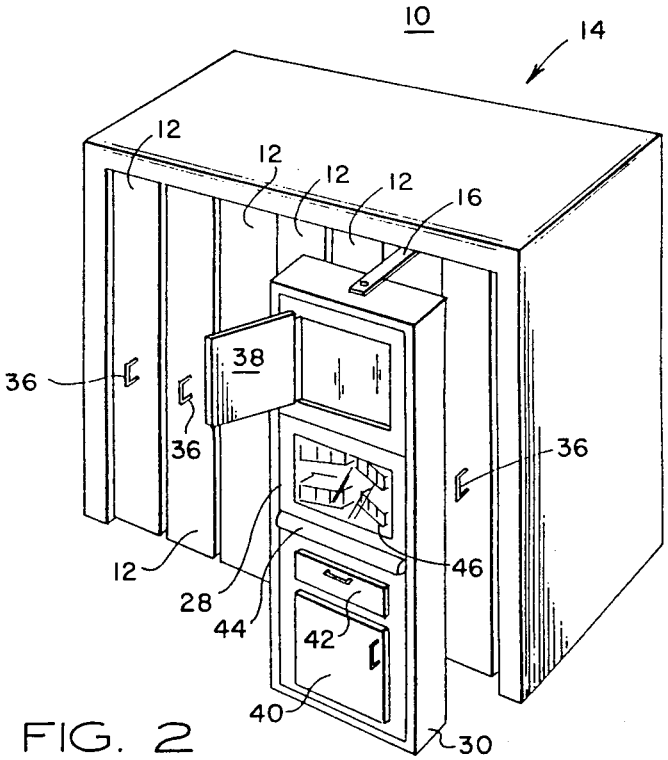
FIG. 2 is a perspective view of the display device according to the present invention, in which the removed module is shown rotated approximately 90 degrees from the position illustrated in FIG. 1 and a portion of the interior of the module is exposed.

Referring initially to FIGS. 1 and 2, a display device according to the present invention is comprised of a plurality of display modules 12 disposed in horizontal juxtaposition within a housing 14. Housing 14 has an open front for receiving each of the modules 12 therein.

Figure 3:
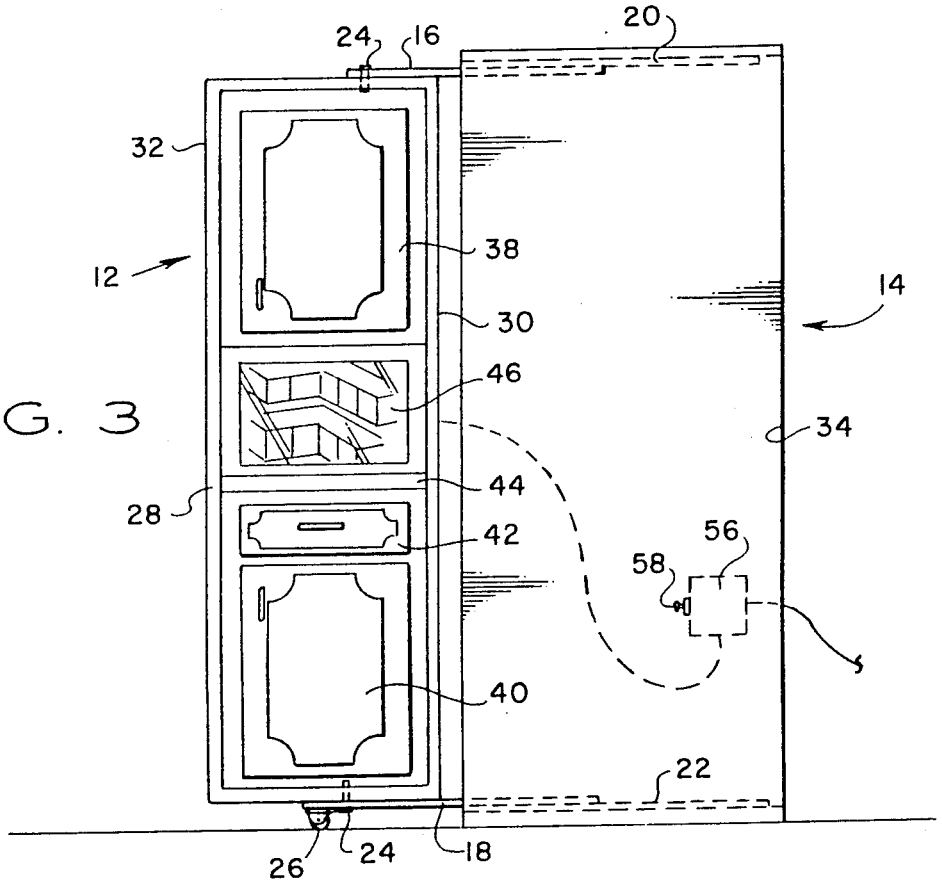
FIG. 3 is a side elevation view of the display device, illustrating portions of the interior of the display housing in phantom.

As can be best seen in FIG. 3, each module 12 is pivotally mounted to top and bottom guide members 16 and 18. Guide members 16 and 18 are in slidable engagement within respective top and bottom guide channels 20 and 22 disposed on the inside of housing 14. The channels 20 and 22 complement with their respective top and bottom guide members 16 and 18 to provide a telescoping guide arrangement. Consequently, the resulting sliding engagement between top and bottom guide members 16 and 18 within their respective top and bottom guide channels 20 and 22 facilitates the sliding movement of the connected module 12 into and out of housing 14, thus constraining that module to slide in and out of housing 14 along a relatively straight path.

Each module 12 is pivotally connected to the corresponding top and bottom guide members 16 and 18 by pins 24. A roller 26 is positioned just forward of lower pin 24 to provide journal support for module 12, particularly when the module is in its fully extended position shown in FIG. 3.

In accordance with a preferred embodiment of the invention, each module 12 has opposed first and second side display panels 28 and 29 and opposed end panels 30 (FIG. 2) and 32 (FIG. 1) interconnected to define a substantially enclosed casing. The end panel 30 is in facing relationship with inner rear wall 34 of housing 14, and its opposed end panel 32 faces outwardly from housing 14. A handle 36 is disposed on end panel 32 to facilitate the respective withdrawal and replacement of the corresponding module 12 into and out of housing 14.

Side display panels 28 and 29 are each adapted for displaying merchandise samples as well as a graphic depicting a layout of such merchandise. Specifically, each display panel 28 and 29 has a plurality of openings for receiving merchandise samples and the graphic; and retaining means, described in greater detail hereafter, is provided for positioning the merchandise samples and graphic in registration with these respective openings.

Figure 5:
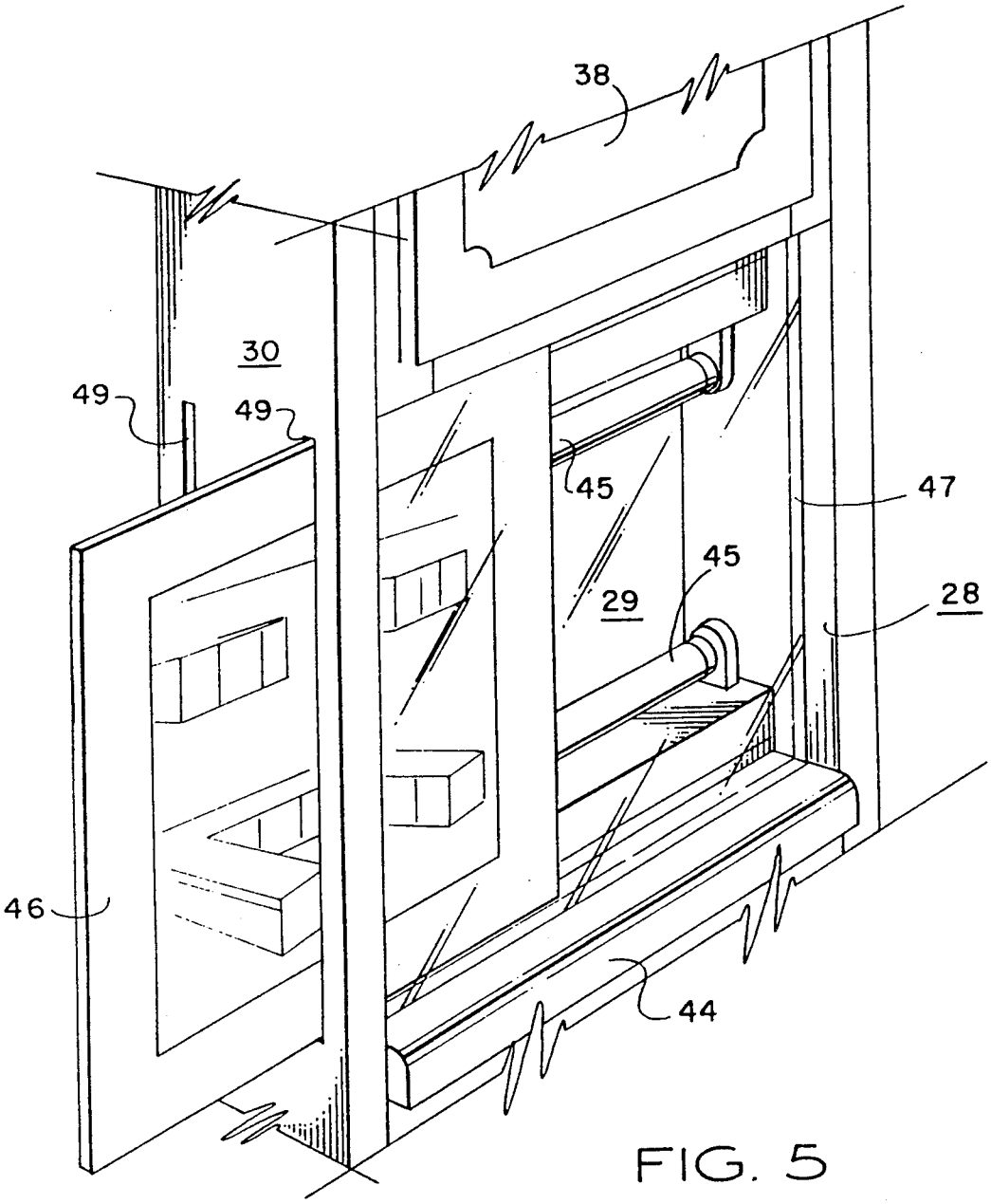
FIG. 5 is a perspective view of a portion of a display module according to the present invention, illustrating the insertion of a phototransparency into a central portion of the module for display.

Referring to FIG. 5, illumination means, such as a fluorescent light 45, is disposed between opposed display panels 28 and 29 in a central portion of each module 12 for backlighting the graphic 46 disposed at each display panel, the graphics 46 preferably being phototransparencies. A recessed slot 47 is provided behind the central opening of each display panel for receiving the peripheral edges of the graphic 46, thereby to retain each graphic 46 in a predetermined fixed position within the corresponding display panel. Graphic 46 can be inserted into its display position through a relatively narrow opening 49 provided in end panel 30.

Referring specifically to FIG. 3, an electrical switch assembly 56 is mounted on or adjacent inner rear wall 34 of housing 14 behind each of the modules 12 for controlling the operation of each light source 45 (FIG. 5) in a module. Specifically, switch 56 includes a member 58 projecting from the rear wall 34 into the interior of housing 14. Projection 58 is preferably spring-biased toward its extended position shown in FIG. 3 and, when so extended, actuates light source 45. Thus, when the particular module 12 is retracted into the housing 14, its end panel 30 will depress member 58 and disable light source 45. Correspondingly, when the particular module 12 is withdrawn from housing 14, as shown in FIG. 3, the projecting member 58 will be spring-biased to its extended position to activate light source 45, thereby illuminating graphic 46. Electrical switch 56 is preferably interposed between light 45 and an electrical power source, (not shown) from a typical wall socket.

In accordance with a feature of the invention, as shown in FIG. 1, each module 12 can be withdrawn from the housing 14, independently of the other modules 12, such that the displays on both side display panels 28 and 29 are visible. If it is desired to view only one of the display panels, module 12 can then be pivoted, as shown in FIG. 2, such that the desired display panel is conveniently presented.

In accordance with another feature of the invention, the graphic 46 depicts a selected use or application of the particular merchandise displayed on the corresponding side panel, and the merchandise samples are positioned on the corresponding display panel in the same layout as that depicted in the graphic. For example, as shown in FIG. 2, the merchandise samples may be kitchen fixtures, such as upper and lower cabinets 38 and 40, kitchen drawer 42, and a countertop piece 44 disposed above drawer 42. A graphic 46 then depicts the kitchen having the aforementioned kitchen fixtures with the specific layout of the upper and lower cabinets, drawer and countertop being substantially the same as the layout depicted in the graphic 46. Thus, an actual three-dimensional merchandise display is associated with the graphic displaying the use of such merchandise.

Figure 4:
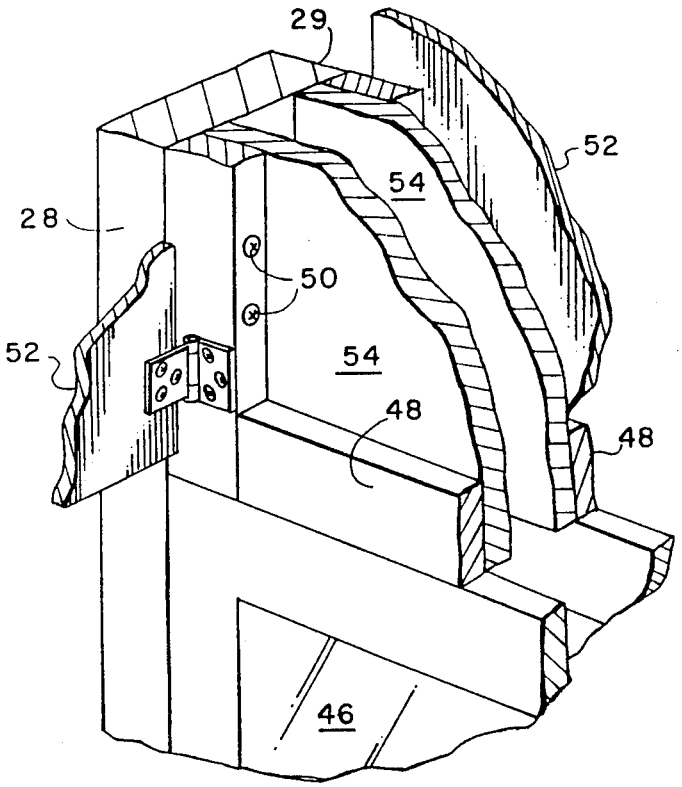
FIG. 4 is a perspective view of a portion of a display module according to the present invention, illustrating the means by which merchandise samples are attached to the display module.

Referring to FIG. 4, upper and lower cabinets 38 and 40 are each comprised of a frame member 48 which is received within a top opening in the corresponding display panel 28 or 29. Each frame member 48 is preferably removably attached by pins 50 or the like to respective portions of such panel 28 or 29 surrounding the top opening. A door member 52 is hingedly connected to frame member 48 and can be opened and closed in the manner typical of a cabinet door. When door member 52 is open, a back portion 54 of frame member 48 is visible, the back portion 54 simulating the interior of the actual kitchen cabinet depicted in graphic 46. Lower cabinet 40 is received within a corresponding lower opening in the corresponding side panel 28 or 29 and is secured thereto in substantially the same manner as upper cabinet 38. The particular frame member simulating lower cabinet 40 may also include drawer 42 and countertop piece 44 in addition to a corresponding door member hingedly connected to the frame member.

One skilled in the art will appreciate that the display device according to the present invention provides substantial space savings for a typical floor display by providing a plurality of vertically oriented, horizontally juxtaposed, display modules, each of which can display merchandise on both the front and back display panels thereof. The modules are independently removable from a display housing and can be pivoted for convenient viewing of both of the display panels. The graphics depicting the merchandise are illuminated when the corresponding module is withdrawn from the housing. Actual merchandise samples, as well as graphics depicting the use or application of the merchandise, can be conveniently displayed.

Various alternate embodiments of the invention, as well as modifications to the above-described preferred embodiment, may be made without departing from the nature, spirit and scope of the invention, and the invention is not to be limited to said details except as set forth in the appended claims.

What is claimed is:

1. A display device, comprising:

a housing;

at least one vertically oriented module being removable from and retractable into said housing;

said module including first and second opposed panels connected to define a substantially enclosed casing, each of said panels for displaying a phototransparency depicting selected merchandise; and means disposed within said enclosed casing and behind said phototransparency for illuminating and backlighting said phototransparency upon removal of said at least one module from said housing.

2. The device of claim 1 further including means for pivotally mounting said casing so that said casing can be pivoted about a vertical axis to expose either or both of the panels for viewing.

3. The device of claim 1 wherein each of said panels is adapted for displaying said phototransparency on a central portion thereof, said illuminating means being positioned in a central portion of the casing for backlighting the phototransparency displayed on each panel.

4. The device of claim 1 further including means for guiding the inward and outward movement of said casing with respect to said housing, said guide means including first and second guide members positioned on respective top and bottom parts of the casing and third and fourth guide members, which are complementary with the respective first and second guide members, positioned in respective top and bottom parts of the housing, said first guide member for slidably engaging said third guide member and said second guide member for slidably engaging said fourth guide member for constraining the sliding movement of said casing with respect to said housing along a relatively straight path.

5. The device of claim 1 wherein said housing has switch means mounted therein for automatically enabling said illuminating means when said casing is removed from said housing and for automatically disabling said illuminating means when said casing is retracted into the housing.

6. The device of claim 5 wherein said switch means includes a switch member projecting into the housing from a rear wall thereof, said switch member being depressed by a portion of the casing in facing relationship with the rear wall of the housing when the casing is retracted into the housing, to maintain the switch means in an "off" state for disabling the illuminating means, said switch member being spring-biased to move outwardly from said rear wall when the casing is removed from the housing, thereby changing the switch means to an "on" state to enable the illuminating means.

7. The device of claim 1 further including handle means disposed on said casing to facilitate the movement of said casing with respect to said housing.

8. The device of claim 1 wherein said device includes a plurality of vertically oriented modules in horizontal juxtaposition, each of said modules being independently removable from and retractable into said housing.

9. A display device, comprising:

a housing;

at least one vertically oriented module having first and second opposed panels, each of said panels retaining a merchandise display depicting selected merchandise, said module being removable from and retractable into said housing;

said merchandise display including a pictorial graphic and samples of said selected merchandise, said samples being disposed in an arrangement corresponding to the subject of said pictorial graphic;

the first and second opposed panels connected to define a substantially enclosed casing, with the pictorial graphic on a central portion of each of said panels; and illuminating means positioned in a central portion of the said casing for backlighting the said pictorial graphic.

10. The device of claim 9 further including means for retaining said samples and said graphic in respective display positions, said samples and said graphic being detachable from each of said panels.

11. The device of claim 10 wherein said graphic is comprised of a relatively flat transparency and said retaining means include slot means for receiving respective peripheral edges of the transparency to retain the transparency in a predetermined position for viewing.

12. The device of claim 9 wherein said merchandise is comprised of sample kitchen fixtures, including upper and lower cabinets with a drawer and countertop piece disposed therebetween, said graphic being disposed between the upper cabinet and the countertop piece for depicting the kitchen fixtures in situ.

13. A display device, comprising:

a housing;

at least one vertically oriented module having first and second opposed panels for displaying a merchandise display depicting selected merchandise, said module being removable from and retractable into said housing;

said merchandise display including a pictorial graphic and samples of said selected merchandise, said samples being disposed in a selected arrangement corresponding to the content of said pictorial graphic;

said first and second opposed panels connected to define a substantially enclosed casing;

illuminating means for illuminating said graphic; and switch means for automatically enabling said illuminating means when said casing is removed from said housing and for automatically disabling said illuminating means when said module is retracted into said housing.

14. The device of claim 13 further including means for pivotally mounting said casing so that said casing can be pivoted about a vertical axis to expose either or both of the panels for viewing.

15. The device of claim 13 further including means for guiding the inward and outward movement of said casing with respect to said housing, said guide means including first and second guide members positioned on respective top and bottom parts of the casing and third and fourth guide members, which are complementary with the respective top and bottom parts of the housing, said first guide member for slidably engaging said third guide member and said second guide member for slidably engaging said fourth guide member for constraining the sliding movement of said casing with respect to said housing along a relatively straight path.

16. The device of claim 13 wherein said switch means includes a switch member projecting into the housing from a rear wall thereof, said switch member being depressed by a portion of the casing in facing relationship with the rear wall of the housing when the casing is retracted into the housing, to maintain the switch means in an "off" state for disabling the illuminating means, said switch member being spring-biased to move outwardly from said rear wall when the casing is removed from the housing, thereby changing the switch means to an "on" state to enable the illuminating means.

17. The device of claim 13 further including handle means disposed on said casing to facilitate the movement of said casing with respect to said housing.

18. The device of claim 13 wherein said device includes a plurality of vertically oriented modules in horizontal juxtaposition, each of said modules being independently removable from and retractable into said housing.

* * * * *

UNITED STATES PATENT AND TRADEMARK OFFICE

CERTIFICATE OF CORRECTION

PATENT NO. : 5,057,977

DATED : October 15, 1991

INVENTOR(S) : Alan M. Kurzman

It is certified that error appears in the above-identified patent and that said Letters Patent is hereby corrected as shown below:

Column 6, line 65, after "...with the respective", insert "first and second guide members, positioned in respective".

Signed and Sealed this

Second Day of March, 1993

*Attest:*

STEPHEN G. KUNIN

*Attesting Officer*

*Acting Commissioner of Patents and Trademarks*